United States Patent [19]

Thaxter

[11] 4,284,031

[45] Aug. 18, 1981

[54] MAGNETIC TRANSFER SURFACE FOR CONTROLLING TONER THICKNESS

[75] Inventor: James B. Thaxter, Townsend, Mass.

[73] Assignee: Sperry Corporation, New York, N.Y.

[21] Appl. No.: 931,215

[22] Filed: Aug. 4, 1978

[51] Int. Cl.[3] ..... G03G 15/09

[52] U.S. Cl. ..... 118/657; 101/DIG. 13; 346/135.1

[58] Field of Search ..... 346/74.1; 118/657, 653, 118/658, 621, 623; 101/DIG. 13; 430/122; 198/690, 691; 355/30 R

[56] References Cited

U.S. PATENT DOCUMENTS

| | | | |
|---|---|---|---|
| 2,832,311 | 4/1958 | Byrne | 118/657 |
| 3,437,074 | 4/1969 | Hagopian et al. | 198/690 |
| 3,584,601 | 6/1971 | Turner | 118/657 |
| 3,777,707 | 12/1973 | Hodges | 118/657 |
| 4,122,456 | 10/1978 | Berkowitz | 118/657 |

*Primary Examiner*—Richard L. Schilling
*Assistant Examiner*—John L. Goodrow
*Attorney, Agent, or Firm*—Howard P. Terry

[57] ABSTRACT

In an electrophoretic printer for printing an image on a recipient sheet, magnetic tape means having a predetermined magnetization reversal is utilized to control the thickness of the toner layer thereon.

3 Claims, 4 Drawing Figures

MAGNETIC TRANSFER SURFACE FOR CONTROLLING TONER THICKNESS

BACKGROUND OF THE INVENTION

1. Field of the Invention

This invention relates to printing apparatus and, more particularly, to magnetic means for controlling the thickness of a toner layer applied to a transfer surface prior to printing.

2. Description of the Prior Art

Printing methods which employ an electrical field to move particulate printing material, toner, to a recipient sheet forming an image thereon are known in the prior art. One such printing process employs a printing sheet and a transfer surface or belt from which the toner is conveyed to a print head which establishes an electrical field for transferring the toner material to the recipient sheet or paper. The imprinted paper passes over a hot plate of sufficient temperature and length to fuse the paper and toner. A method of supplying toner to the recipient sheet that has been considered envisions using a permanently toned ribbon which would be used only once and then discarded. As this scheme is generally not practical, a continuous printer having a retoneable transfer surface or belt in contact with the toner, preferably a toner bead, for coating the belt has been considered. The rotating toner bead is comprised of fine magnetic particles and is formed by magnetic field gradients from a plurality of magnets employed above and below the bead and on opposite sides of the belt.

In general, the rotating magnetic bead scheme works well at low transfer belt velocities, that is, on the order of 20 inches per second, and when used with a rough surface belt. Present printing requirements, however, indicate that printing speeds on the order of 50–60 inches a second or more are desirous. However, as the rotating magnetic bead tends to fly apart at belt velocities on the order of 30 inches per second, a 60 inch per second belt velocity would require a bead four times larger in diameter and magnets eight times more massive (assuming the same magnetic material) than those originally used in the 20 inch per second system. Furthermore, at these faster speeds uniform coating and thickness control of the toner layer on the transfer surface is difficult.

Thickness control of the toner layer, as well as uniform coating of the transport surface, moreover, is required for good, dense printing, especially at the high speeds, 50–60 inches per second, now being considered. That is, at the present speeds of about 20 inches per second, the belt transports the toner layer thereon past the print head at approximately the same speed as the recipient paper is moved past the print head, because the transport surface is coated with a toner layer of limited area density. Furthermore, the present limited area density is approximately equal to the area density of toner required to be transferred onto the paper for high quality, dense printing. In other words, in the present systems substantially total transfer of the toner layer from the belt to the paper is necessary to achieve the required printing quality at 20 inches per second. If the density of the toner layer carried by the belt could be controlled, e.g., substantially increased, that is, if the toner layer thickness could be controlled, the transport surface could be run at a substantially reduced speed from that of the paper, thereby reducing, among other factors, the possibility of toner spillage.

Accordingly, there is a need for providing means for providing a dense toner layer and for controlling the thickness of the toner layer for relatively fast transport surface speeds without sacrificing good printing characteristics.

SUMMARY OF THE INVENTION

According to the invention, magnetic means for controlling the thickness of the toner layer on the transfer surface of a non-impact printer is provided. Illustratively, the apparatus of this invention includes magnetic tape means having a predetermined magnetization for transporting the toner from a toner supply to the print head where the toner is transferred to the recipient sheet.

Specifically the apparatus of this invention includes a supply of toner of moderate magnetic susceptibility, magnetic transfer surface means for transporting the toner to a print head where the toner on the transport surface means is transferred to a recipient sheet at the print head forming an image thereon. The magnetic transport surface means is provided with a predetermined periodic magnetization reversal, whereby the pitch, the distance along the transport surface means between magnetization reversal cycles, controls the thickness of the toner layer on the transport surface. The magnetization reversals, moreover, may be oriented perpendicular to the plane of the transport surface, or in the plane of the surface with an orientation in the direction parallel to the length of the transport surface or the direction of motion of the magnetic transport surface means.

More specifically, the magnetic transport surface means includes a magnetic tape having a predetermined magnetization reversal, oriented in the direction of the length of the tape; magnetic roller means disposed opposite the transport surface of the tape for transferring the toner from the toner supply to the magnetic tape and a high permeability (high $\mu$) backing plate disposed opposite the other surface of the tape and opposite the magnetic roller, whereby the backing plate aids in the transferral of the toner to the magnetic tape and the magnetic tape pitch controls the thickness of the toner layer thereon.

DESCRIPTION OF THE PREFERRED EMBODIMENTS

For a more complete appreciation of the invention, attention is invited to the following description of an illustrative embodiment of the invention, as shown in the attached drawings.

Figure 1:
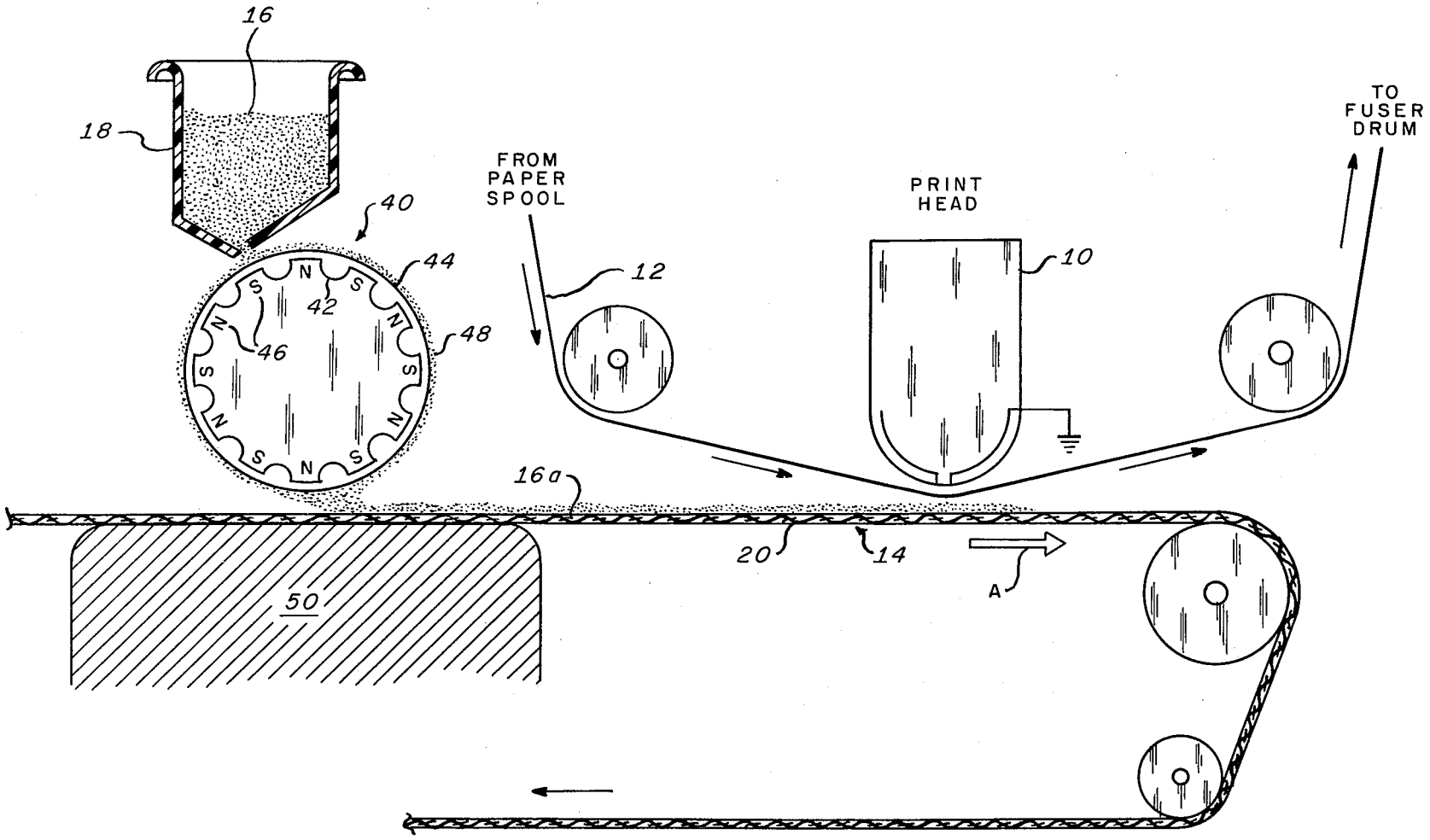
FIG. 1 indicates a preferred embodiment of this invention.

FIG. 1 includes an electrophoretic printing process, known in the art, such as disclosed in Haerberle et al U.S. Pat. No. 3,550,153 granted on Dec. 22, 1970, embodying a print head 10, a supply of recipient sheet or paper 12, from a paper supply or spool, not shown, conveyed by suitable means across the print head 10 to a fuser section not shown. The printing process further includes means including a transport surface or belt 14 for conveying, in the direction of arrow A, a supply of toner 16 from a toner supply, hopper, 18 in a uniform layer 16*a* to the print head 10. The toner particles 16 are typically of the form of a solid shell of a magnetic oxide $Fe_3O_4$ powder in a pigmented resinous binder coated with a carbon powder to provide a conducting surface thereon. In the electrophoretic printing process, the toner particles are transferred from the belt 14 to the paper 12 by means of the electrical field initiated by the print head 10. The magnetic oxide or iron oxide $Fe_3O_4$ content of the toner particles 16 is advantageously used in this invention such that high speed printing may be accomplished by providing magnetic means to influence the particles to control the thickness of the toner layer 16*a*.

Figure 2:
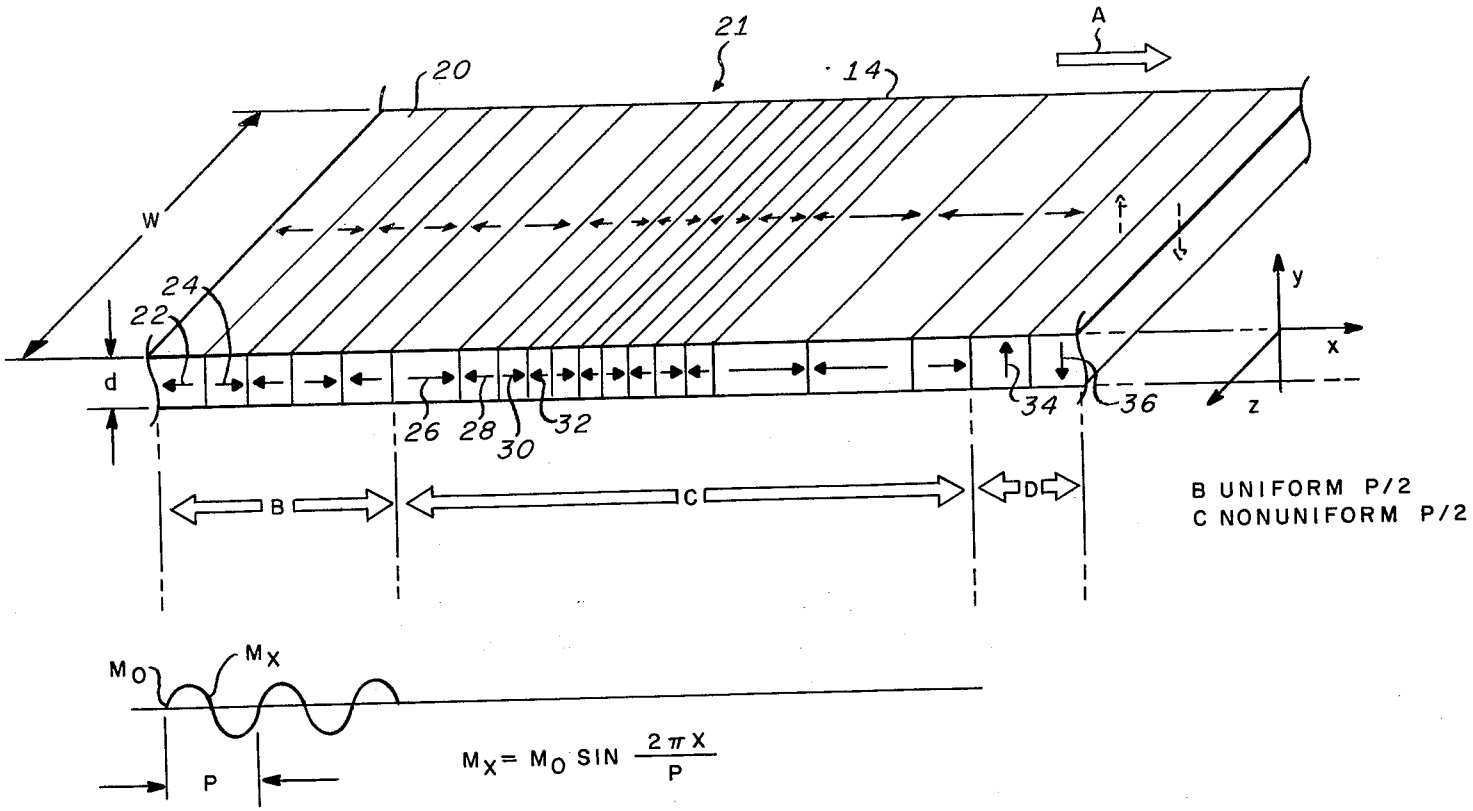
FIG. 2 illustrates in schematic a portion of the transport surface of the magnetic transport means of this invention having a predetermined magnetization thereon.

Specifically, the magnetic means of this invention which controls the thickness of the toner layer 16*a* is provided by the magnetization of the transport surface 14 forming a magnetized belt 20 (FIG. 2) of predetermined magnetization. That is, the transport surface 14 comprises a magnetized belt 20 having a periodic magnetization reversal formed therein. Referring to FIG. 2, a portion 21 of the magnetic transport surface 20 is shown having a predetermined periodic (B) magnetization reversal indicated by arrows 22, 24 and an aperiodic (C) magnetization reversal indicated by arrows 26, 28, 30, 32 of varying periodicity in the plane of the surface to be explained herein. The magnetic transport surface means or magnetic belt 20 having a predetermined magnetization reversal indicated by arrows 22, 24 may be a magnetic tape such as the transport surface 14 illustrated in FIG. 1 or a magnetized surface 20*a* formed on a drum 60, see FIG. 3, where the magnetic belt of FIG. 2 may be considered to represent a portion 21 of the transport surface 20*a* of the drum 60 which may be assumed flat. Moreover, the magnetization reversal of the belt 20 may be oriented perpendicular to the plane of the surface of the belt 20 as illustrated by portion (D) of the belt and magnetization reversal arrows 34, 36, see FIG. 2. However, in the preferred embodiment of the invention the magnetization reversal is oriented in the plane of the surface and parallel to the direction of motion, illustrated by arrow (A), or along the x axis, see FIG. 2.

Referring to FIG. 2, the magnetic transport surface belt 20, having a direction of motion A, has an associated x,y,z coordinate system, in which the direction of motion is directed along the x axis and the y axis is perpendicular to the plane of the surface of the belt 20 and the z axis is perpendicular to both the x and y axes. For a periodic magnetization reversal or pitch P along the x axis as shown in section (B) thereof, the magnetization $M_x$ of the belt varies along the x axis of the surface as follows:

$$M_x = Mo \sin \frac{2\pi x}{P} \tag{1}$$

where Mo is the maximum magnetization. Furthermore, the magnetic field (H) of the periodic magnetization of the magnetic transport surface 20 may be expressed as the field of an array of dipoles arranged in a plane, which is known to decrease rapidly as the distance from the plane increases, and may be expressed as:

$$H \; \alpha \; Mo \, e^{\frac{-2\pi y}{P}} \tag{2}$$

In addition, if the magnetic toner particles are comprised of a "soft" magnetic material as explained hereinabove, and if the particles are influenced by a magnetic field or, more specifically, when magnetized by the field of the magnetic transport belt 20, the magnetic force on the particles is proportional to the gradient of the square of the magnetic field, and may be expressed as:

$$\text{Force } \alpha \left( \frac{2\pi Mo}{P} \right)^2 e^{\frac{-4\pi y}{P}} \tag{3}$$

Therefore, with regard to the toner particles, the region of significant magnetic force measured from the x axis and along the y axis of the belt 20 is confined to a distance or layer of thickness approximately equal to the pitch P of the magnetization reversals. Thus, control of the thickness of the toner layer 16*a* is advantageously adjusted by the instant invention by controlling the pitch P of the magnetization reversal of the transfer surface 20.

Referring back to FIG. 1, a preferred embodiment of the invention is shown in which transfer means is illustrated comprising a magnetic roller 40 disposed beneath the hopper 18. The magnetic roller 40 attracts toner particles 16 released from the hopper to the magnetic roller or brush 40 for uniform deposit on the magnetic transport belt 20, having a predetermined magnetization. The magnetic brush 40 comprises an inner surface 42 and an outer shell 44. The inner surface 22 is formed of a magnetic material having a repetitive pole configuration, that is, a repeating North (N), South (S) finger-like pole extension configuration 46, which attracts the magnetic toner particles 16 to the outer shell 44 of the brush. The magnetic roller 40 therefore attracts a layer of toner particles 48 disposed about the periphery of the roller for transferral to the magnetic transport belt 20. It is noted that the roller may be made of sufficiently large radius to reduce the centrifugal force on the toner 16 or layer 48 for a given surface velocity of the roller and the belt. In addition, the centrally located magnetic pole configuration 46 or the resultant magnetic field gradients thereof exert a relatively constant centripetal force on the toner layer 48 to confine the layer 48 to the roller 40. It is noted that when employing the magnetic brush 40 for transferring the toner 16 to the magnetic belt 20, the periodic magnetization reversals should lie in the plane of the magnetic transport surface belt 20, otherwise the magnetic fields of the brush 40 may destroy those gradients of the field of the magnetized transport surface 20 oppositely directed to the fields of the brush 40. Furthermore, the demagnetizing effects of the brush 40, or any other magnetic field source, may be reduced if the fields are directed normal to the magnetization in the surface 20. The fields of the magnetic brush 40 may be constrained normal to the transport surface 20 by means of a high permeability (high $\mu$) plate 50 (FIG. 1) made of a material such as iron disposed opposite the brush 40 with the magnetic belt 20 disposed between the brush 40 and plate 50. In FIG. 1, the belt 20 is disposed above the plate 50 such that the plate also acts as a guide for the belt. The magnetic field of the roller 40 will induce a magnetization in the highly permeable backing plate 50 which sets up opposing forces to reduce the net normal force on the toner particles in the area between the roller and the backing plate. The high permeability of the backing plate 50 or the induced magnetization thereof results in the cancellation of the tangential component of the magnetic field and the normal magnetic field gradient attracting the toner to the magnetic roller 40. Furthermore, the high permeability backing plate 50 cancels the centripetal force on the toner layer 48 near the surface of the backing plate such that the toner particles 16 may be deposited on the belt 20 in a uniform manner, such as layer 16*a*, as more fully described in Applicant's copending application Ser. No. 931,214 Thus, high speed printing may be accomplished due to the deposition or transferral of a uniform toner layer 16*a* to the magnetic belt 20 by means of the magnetic roller 40 in cooperation with the backing plate 50 of high permeability material, and by controlling the thickness of the layer 16*a* by controlling the pitch P of the magnetization reversals of the transport surface belt 20.

In the situation wherein the magnetized transport surface 20 has a predetermined periodic (P) magnetization reversal as illustrated in section (D) of FIG. 2, the magnetic force of the transport surface will selectively attract a toner particle having a characteristic size, or diameter, on the order of the size of the pitch P. If the toner 16 is comprised of a constant size particle on the order of the size of the pitch P, a uniform dense thick toner layer will be formed on the belt 20. However, as is common to toner material, the sizes of the toner particles vary over a range of 10 to 1 and, therefore the particles larger than and/or smaller than the pitch P will not be so attracted resulting in an uneconomical operation. Accordingly, if a preselected aperiodic pitch (C), FIG. 2, corresponding to the variation in particle size is formed in the transport surface 20, the magnetic belt 20 will select a broader range of particles, i.e., substantially all of the toner particles will be distributed in a controlled uniform dense or thick toner transfer layer 16*a*. It is noted that in the instance of preselected aperiodic pitch (C), the range of pitch period and the distribution of available particle sizes will result in a variation in toner layer thickness, in accordance with Eq. 3 greater than the case for a single valued pitch period; however, the control of the toner layer 16*a* is not effected. This trade-off is useful, moreover, when the gap between the toner transport surface (20) and the paper is sufficient to accept slight toner layer thickness change which in turn allows a greater distribution of toner sizes to be used in the printing process.

Figure 3:
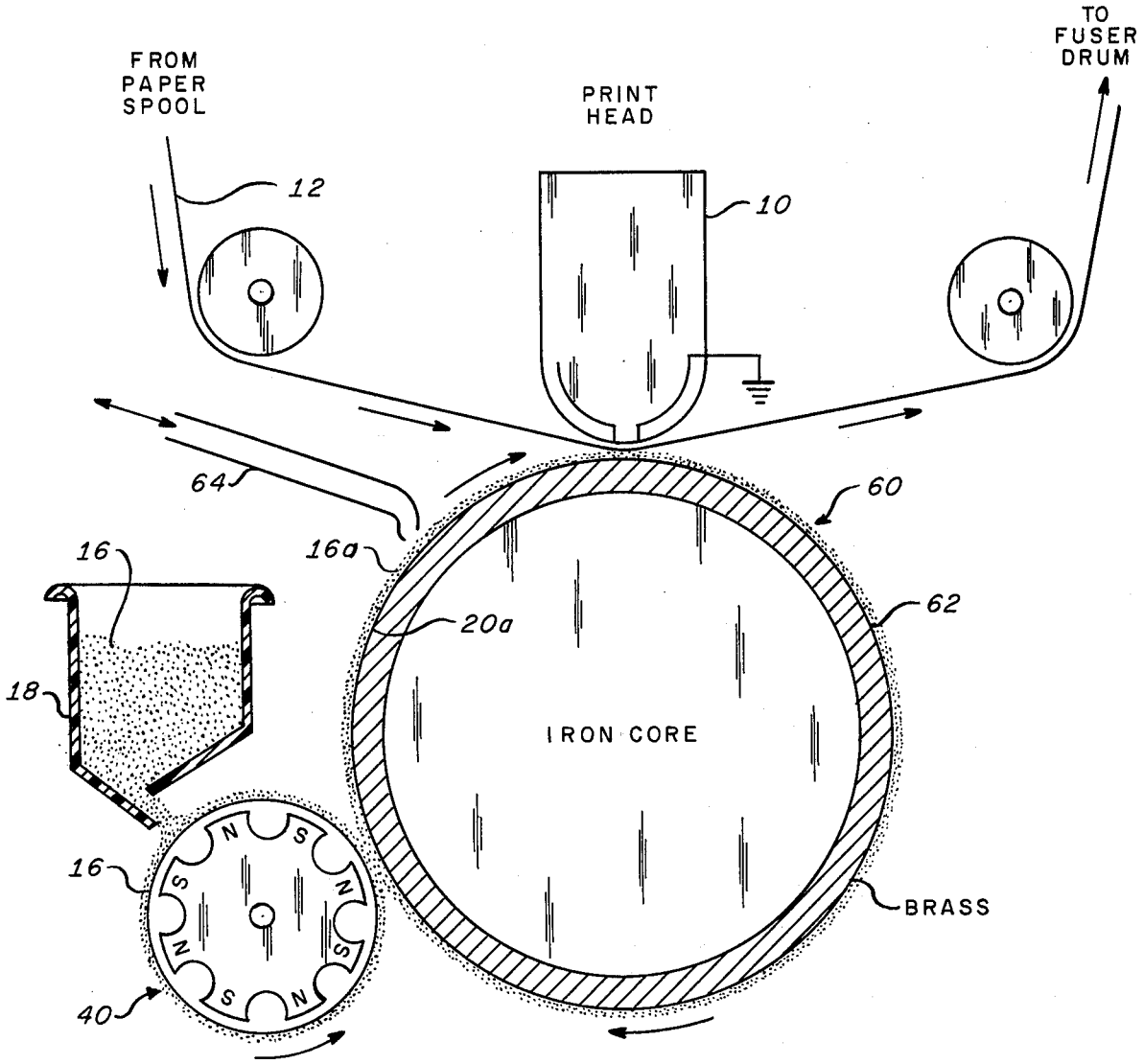
FIGS. 3 and 4 indicate further embodiments of the invention.
Figure 4:
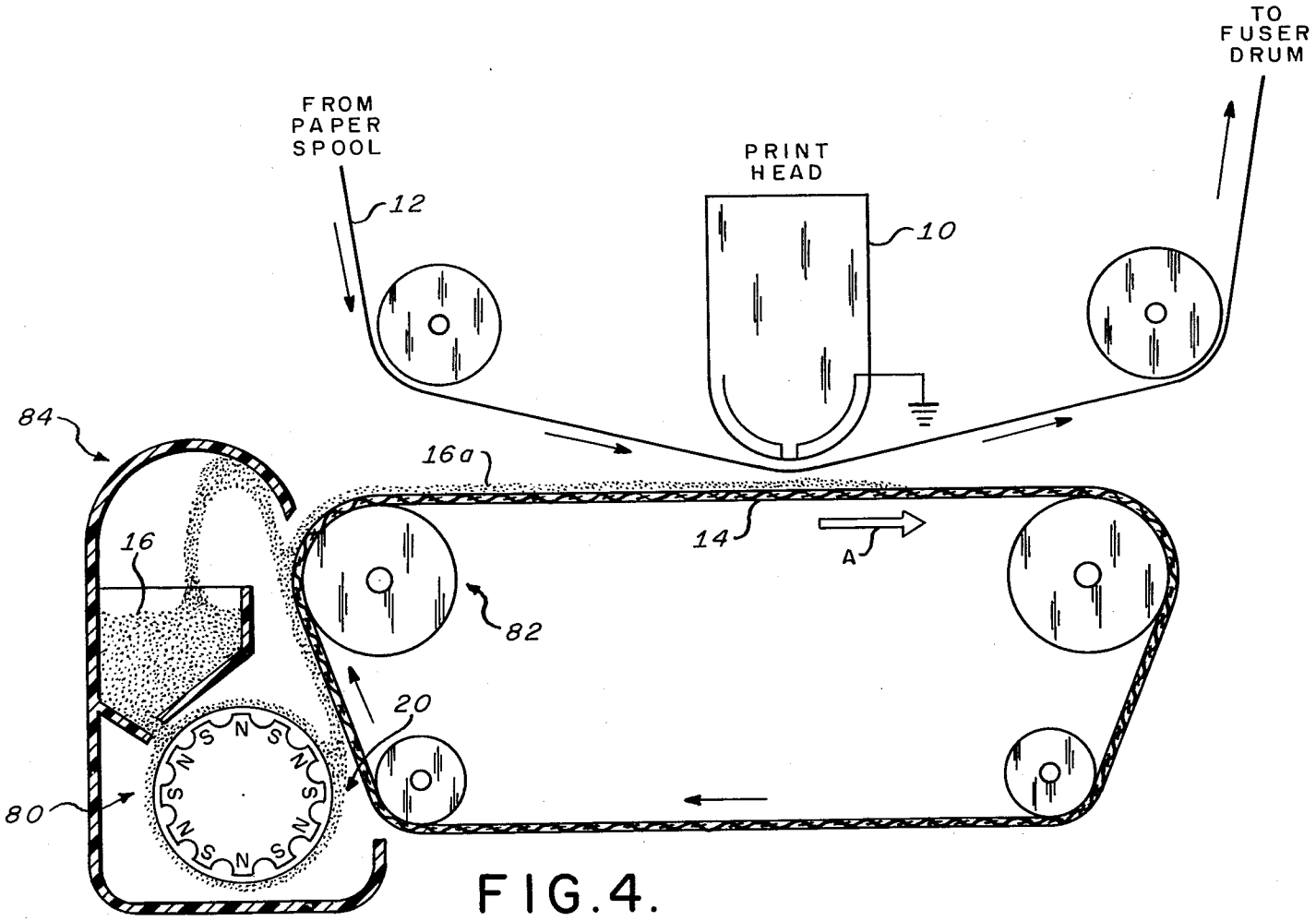

Referring to FIG. 3, an embodiment of the invention is illustrated wherein the magnetic transport surface 20*a* is formed on a large drum 60. In this embodiment, a magnetic brush 40 in association with a high permeability magnetic material inner surface 62 of the drum transfers the toner 16 to the magnetic transport surface 20*a* thereof. As illustrated in FIGS. 3 and 4 means may be utilized to collect excess toner. For example, in FIG. 3 a low pressure air supply tube 64 may be utilized to strip away excess or overly thick layers of toner material for return to the toner supply. Whereas, in the embodiment of the invention of FIG. 4 suitable transfer means 80 transfers the toner to the endless magnetic belt 20 and idler 82 is provided to redirect the belt such that a centripetal force is developed of sufficient strength to strip away any excess toner. Cover means 84 may be utilized to capture and return the stripped toner to the toner supply.

In accordance with the apparatus of this invention, a magnetic transport system is provided which permits high speed printing by controlling the thickness of toner on the transport surface for transport thereof to a print head.

While the invention has been described in its preferred embodiments, it is to be understood that the words which have been used are words of description rather than limitation and that changes within the purview of the appended claims may be made without departing from the true scope and spirit of the invention in its broader aspects.

I claim:

1. An electrophoretic printer for printing an image upon a recipient sheet comprising:

a reservoir of magnetically susceptible toner;

magnetic brush means, having an outer surface and an inner surface of repetitive and equally spaced north and south magnetic poles, associated with said reservoir for attracting the magnetically susceptible toner;

magnetic transport surface means having an aperiodic magnetic reversal pattern thereon, said magnetic reversal pattern having a pitch selected to provide a desired thickness of magnetically susceptible toner received by the magnetic surface transport means, aligned and cooperating with said magnetic brush means; and a print head situated above said magnetic transport surface to receive simultaneously the recipient sheet and the layer of magnetically susceptible toner.

2. An electrophoretic printer according to claim 1 wherein the magnetization of the transport surface is oriented in the plane of the surface and parallel to the longitudinal extent thereof.

3. An electrophoretic printer according to claim 1 wherein the magnetization of the transport surface is oriented perpendicular to the plane of the surface.

* * * * *